United States Patent [19]

Hirano

[11] Patent Number: 4,879,937

[45] Date of Patent: Nov. 14, 1989

[54] SOUND EFFECTOR

[75] Inventor: Taichi Hirano, Aichi, Japan

[73] Assignee: Prince Tsushinkogyo Limited, Nagoya, Japan

[21] Appl. No.: 149,148

[22] Filed: Jan. 27, 1988

[30] Foreign Application Priority Data

Apr. 28, 1987 [JP] Japan ..... 62-105349

[51] Int. Cl.[4] ..... G10H 3/00; G10H 1/02

[52] U.S. Cl. ..... 84/699; 84/DIG. 10; 84/701; 84/723

[58] Field of Search ..... 84/1.11, 1.12, 1.14–1.16, 84/DIG. 9, DIG. 10, 1.24, 1.25, 1.27, 1.06, 1.04; 381/61; 307/520, 542, 543, 545; 328/5, 128, 162

[56] References Cited

U.S. PATENT DOCUMENTS

| | | | |
|---|---|---|---|
| 2,784,631 | 3/1957 | Fender | 84/1.16 |
| 3,813,473 | 5/1974 | Terymenko | 84/1.16 |
| 3,911,776 | 10/1975 | Beigel | 84/1.11 |
| 4,151,368 | 4/1979 | Fricke et al. | 84/DIG. 10 |
| 4,357,852 | 11/1982 | Swenaga | 84/1.24 X |
| 4,382,398 | 5/1983 | O'Neil | 84/DIG. 10 |
| 4,405,832 | 9/1983 | Sondermeyer | 84/1.24 X |
| 4,422,360 | 12/1983 | Carter | 84/1.11 |
| 4,581,975 | 4/1986 | Fender | 84/1.16 X |
| 4,683,589 | 7/1987 | Scholz et al. | 84/1.24 X |
| 4,811,401 | 3/1989 | Brown, Sr. et al. | 84/1.19 X |

*Primary Examiner*—Arthur T. Grimley
*Assistant Examiner*—Matthew S. Smith
*Attorney, Agent, or Firm*—Dennison, Meserole, Pollack & Scheiner

[57] ABSTRACT

A sound effector for changing original sound signals generated from an electric musical instrument and picked up by a pickup element. The effector having an inductance circuit into aurally improved distinctive sounds by suitably distorting the waveform in a frequency band or original sound signals to be enhanced during amplification of the original sound signals. The sound effector includes a resonance circuit having a capacitor connected with the inductance circuit of the pickup element, an amplifier circuit composed of semiconductor elements for amplifying an output signal from the resonance circuit, a filter circuit for receiving the output signal from the amplifier circuit and for passing therethrough a signal having a predetermined frequency range, and a positive feedback circuit for positively feeding back a part of the signal passed through the filter circuit to the resonance circuit.

3 Claims, 4 Drawing Sheets

SOUND EFFECTOR

BACKGROUND OF THE INVENTION

The present invention relates to a sound effector for amplifying original sounds produced from an electric musical instrument such as an electric guitar and for outputting amplified sound signals to a speaker or the like, and more particularly, it relates to such a sound effector which uses semiconductor elements and which may produce aurally effective sound signals by arbitrarily distorting the sound signals in the frequency band to be enhanced.

In a conventional sound effector, amplifier circuits employing vacuum tubes have been employed to partially enhance original sounds generated from an electric musical instrument such as a guitar during amplification of original sound signals by suitably distorting the waveform in the frequency band of the original sound signals to be enhanced and thereby generating aurally improved instrument sounds. By the use of vacuum tubes for the amplifier means, it is possible to obtain delicate tones such as vibration sounds of a metal wire used for a grid and a filament in the vacuum tubes, that is, vibration sounds of a cathode filament in the vacuum tubes. Therefore, the amplifier circuits employing the vacuum tubes are widely used in the conventional sound effectors.

However, as the amplifier vacuum tubes are generally large in size, and are short in life, semiconductor elements having a small size have been used heretofore in place of the vacuum tubes to provide electronic circuits which may produce a comfortable delicate tones similar to those obtained by the amplifier circuits employing vacuum tubes.

FIG. 3 shows an example of conventional electronic circuits employing semiconductor elements. As may be seen, the vibration of the strings or the sound of an electric guitar or the like is picked up by a pickup coil 1, and an output sound signal from the pickup coil 1 is received by an amplifier circuit 2, where the signal is amplified to 50–60 dB. The amplified signal from the amplifier circuit 2 is clipped by two reversely connected diodes 5 and 6 connected after a capacitor 3 and a resistor 4, so that the original sound signal is distorted. The clipped signal is then passed through a filter 7 to generate a signal component having a desired frequency range. Such an electronic circuit 10 is called a "distortion circuit". The output signal from the filter 7 is amplified by a voice amplifier 8, and an amplified sound is outputted from a speaker 9.

However, in the above electronic circuit 10, the quantity of distortion is insufficient since the original sound signals are distorted only by clipping the waveform of the signal received by the diodes 5 and 6. For this reason, it has been attempted to approximate the characteristic of the sound effector to that of the amplifier circuit employing vacuum tubes, by changing the value of the capacitor 3 and the resistor 4 and the characteristic of the amplifier 2 and the filter 7, or by changing the combination of these components.

FIG. 4 shows an example of the amplifier circuit 2 employing semiconductor elements in the electronic circuit 10. The amplifier circuit 2 includes an operational amplifier 21 having external terminals 22 and 23. The output characteristic of the operational amplifier 21 is regulated by changing the capacitance of a capacitor 24 connected between the external terminals 22 and 23.

A negative feedback circuit is formed by resistors 25 and 26 and a capacitor 27 to feed back a negative feedback signal to an inversion input terminal of the operational amplifier 21.

FIG. 5 shows the frequency characteristic of an amplified signal to be generated from the amplifier circuit 2 shown in FIG. 4 and having a like frequency characteristic of the amplifier circuit employing vacuum tubes. In FIG. 5, the abscissa denotes the frequency, and the ordinate denotes the gain of the amplifier circuit. The frequency characteristic curve 11 shows that a peak point P lies at an appropriate frequency Q1 to give a maximum gain G, and that the gain is attenuated in high and low frequency ranges across the peak point P.

It will now be assumed that the peak point P shown in FIG. 5 is identified by the frequency Q1=500 Hz and the gain G=50 dB. If the negative feedback quantity is adjusted by changing the values of the capacitors 24 and 27 and the resistor 25, to thereby adjust attenuation of the negative feedback circuit in the amplifier circuit 2 to 50 dB and phase of the amplifier circuit 2 including the negative feedback circuit to 0 degree with the resistor 26 reduced to below 100 Ω, the amplification degree of the amplifier circuit 2 would become one time (0 dB), but the total amplification degree could be increased to 50 dB by adjusting the capacitor 24. Accordingly, it would be possible to produce stable oscillation and thence generate an output signal having a frequency characteristic with a sharp peak.

To adjust the position of the peak point P to Q1=500 Hz and G=50 dB, each value of the capacitors 24 and 27 and the resistor 25 is adjusted to obtain a gain ($\omega \times$ value of resistor 25 $\times$ value of capacitor 27)=50 dB at Q1=500 Hz, where $\omega$ denotes $2\pi \times$ frequency. Further, the operational amplifier 21 is adjusted to reduce the open loop gain in the frequency range higher than the target frequency of 500 Hz. On the other hand, in the frequency range lower than the target frequency of 500 Hz, $\omega$ will diminish and therefore, the amplification degree of the amplifier circuit 2 will decrease in proportion to $\omega$. Thus, the frequency characteristic as shown in FIG. 5 may be obtained having a peak gain at the target frequency of 500 Hz.

However, when the musical instrument is played by using the above sound effector incorporating the amplifier circuit having the frequency characteristic shown in FIG. 5, there is a problem that too gentle or somewhat indistinctive sounds are felt by the player.

SUMMARY OF THE INVENTION

It is, accordingly, an object of the present invention to provide a sound effector which may arbitrarily set the sound to be enhanced of original sounds produced from an electric musical instrument while maintaining the nuances of the original sounds and which may generate distinctive sounds satisfactory for a musical player.

According to the present invention, there is provided a sound effector for changing original sounds generated from an electric musical instrument and picked up by a pickup means having an inductance circuit into aurally improved distinctive sounds by suitably distorting the waveform in a frequency band of original sound signals to be enhanced during amplification of the original sound signals. The sound effector comprises a resonance circuit having a capacitor connected in with the inductance circuit of the pickup means, an amplifier circuit composed of semiconductor elements for amplifying an output signal from the resonance circuit, a filter circuit for receiving the output signal from the amplifier circuit and for passing therethrough a signal having a predetermined frequency range, and a positive feedback circuit for positively feeding back an output signal of the filter circuit to the resonance circuit.

When the original sounds generated from the electrical instrument are picked up by the pickup means, a voltage corresponding to the magnitude of the original sounds is induced in the inductance circuit of the pickup means. As a result, resonance of a predetermined frequency is generated by the resonance circuit consisting of the inductance circuit and the capacitor connected with the inductance circuit. A resonance signal generated from the resonance circuit is amplified by the amplifier circuit formed by semiconductor elements, and is then inputted to the filter circuit, from which a signal having a predetermined frequency range is generated. The output signal from the filter circuit is mainly received by an external amplifier or the like, and is partially fed back through the positive feedback circuit to the resonance circuit, thereby generating oscillation. As a result, the original sound signal is modulated to distort the waveform in a frequency band in the original sound signal to be enhanced, thus changing the original sound to one having a distinctive sound characteristic.

The invention will be more fully understood from the following detailed description and appended claims when taken with the drawings.

DETAILED DESCRIPTION OF THE PREFERRED EMBODIMENT

Figure 1:
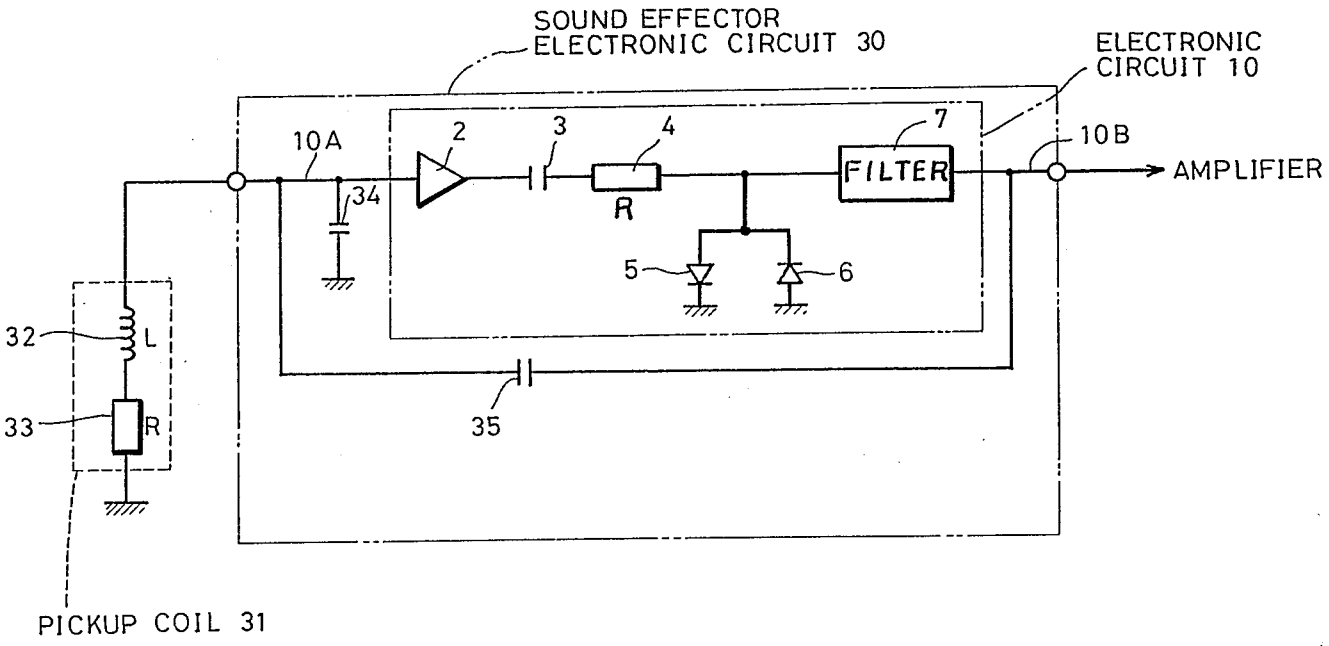
FIG. 1 is an electronic circuit diagram of a sound effector of the present invention.
Figure 3:
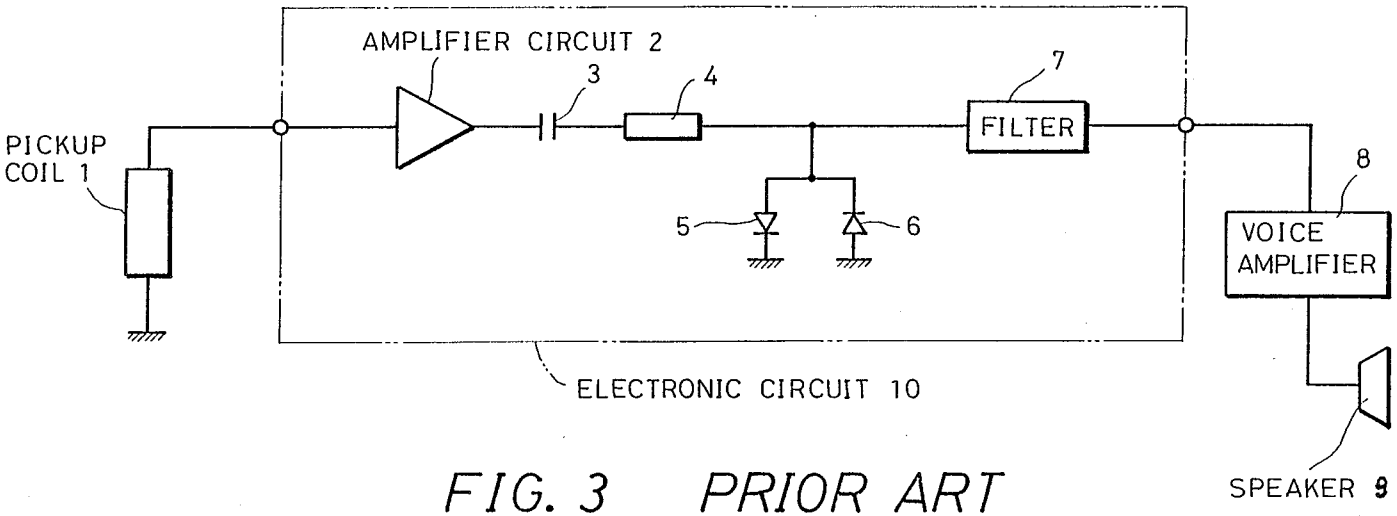
FIG. 3 PRIOR ART
FIG. 3 is an electronic circuit diagram of a conventional sound effector.
Figure 4:
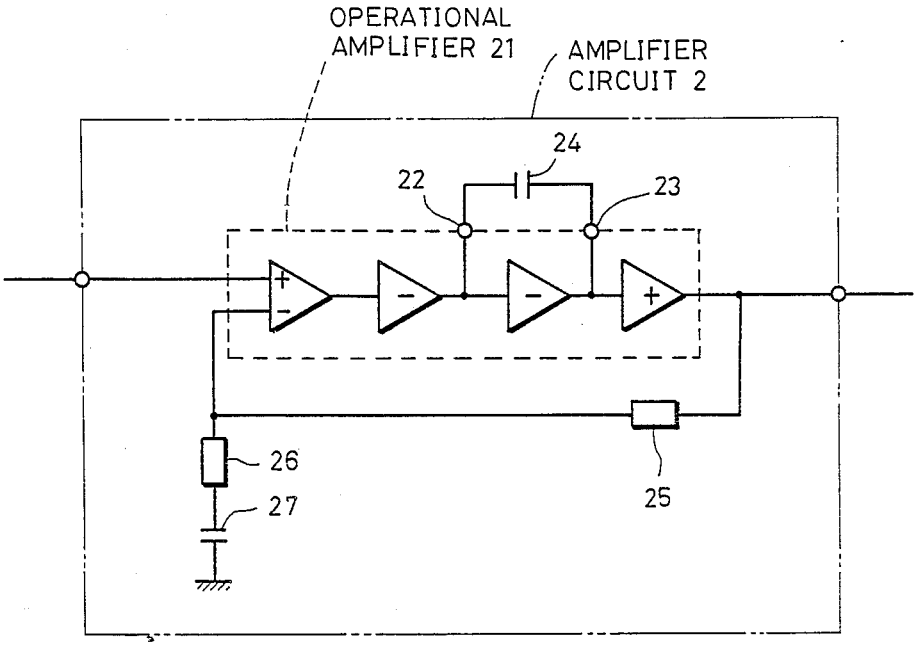
FIG. 4 PRIOR ART
FIG. 4 is a partial electronic circuit diagram of the conventional sound effector shown in FIG. 3.

Referring now to FIG. 1, shown therein and generally designated by the reference numeral 30, is an electronic circuit of a sound effector constructed in accordance with the present invention. As shown therein, the electronic circuit 30 includes an electronic circuit 10 which is identical with that shown in FIG. 3. For purposes of illustration, therefore, all elements of the electronic circuit 10 are numbered to correspond to similar elements of FIG. 3 and the general description of the elements of FIG. 3 are applicable to the corresponding elements of FIG. 1. The electronic circuit 30 also includes a resonance circuit formed by an inductance 32 and an internal resistor 33 of a pickup coil 31 for picking up the vibration of strings of an electric guitar or the like, and by a capacitor 34 connected with the pickup coil 31. The resonance circuit is connected with the input 10A of the electronic circuit 10 between the inductance 32 and the capacitor 34. The output 10B of the electronic circuit 10 is connected with an external amplifier (not shown), and is also connected through a capacitor 35 with the input 10A of the electronic circuit 10. Thus, in the electronic circuit 30, the output signal from the capacity 34 is applied to the electronic circuit 10.

In the electronic circuit 30 of the sound effector, the total impedance Z of the resonance circuit formed by the pickup coil 31 picking up the vibration of the strings of the electric guitar and by the capacitor 34 is expressed as follows:

$$Z=R+j(\omega L-1/\omega C1) \quad (1)$$

where, R is the resonance of the resistor 33 in the pickup coil 31; j is the imaginary unit; $\omega$ is the angular velocity; L is the inductance of the pickup coil 31; and C1 is the capacitance of the capacitor 34.

Accordingly, the current I flowing in the resonance circuit is expressed as follows:

$$I = E/\sqrt{R^2 + (\omega L - 1/\omega C1)^2} \quad (2)$$

where, E is the voltage signal produced in the inductance 32 and having a substantially sinusoidal wave.

When the resonance circuit is resonated, $\omega L-1/\omega C1=0$ is given. Therefore, the current I flowing in the resonance circuit is expressed by $I=E/R$ from Equation (2). Accordingly, a voltage drop Vl by the inductance 32 in the pickup coil 31 is expressed by $Vl=I\times\omega L=E\omega L/R$.

The above equation, $Vl=E\omega L/R$ is modified to obtain the following equation:

$$Vl/E=\omega L/R \quad (3)$$

that is, a ratio between the voltage signal E and the voltage drop by the inductance 32 is expressed by $\omega L/R$. Accordingly, the voltage drop Vl is $\omega L$ times that in a circuit including only the resistor 33 or the inductance 32. When the resonance circuit is in resonant condition, a voltage drop Vc1 by the capacitor 34 is equal to Vl, and $\omega=1/\sqrt{LC1}$ or $L=1/\omega^2C1$ is substituted for $\omega$ or L in Equation (3) to hold $Vc1/E=-1/R\omega C1$. Therefore, the capacitor 34 is supplied with a voltage equal to the voltage drop Vl and having a phase reversed thereto. As a result, current corresponding to the voltage is allowed to flow in the capacitor 34.

Figure 2:
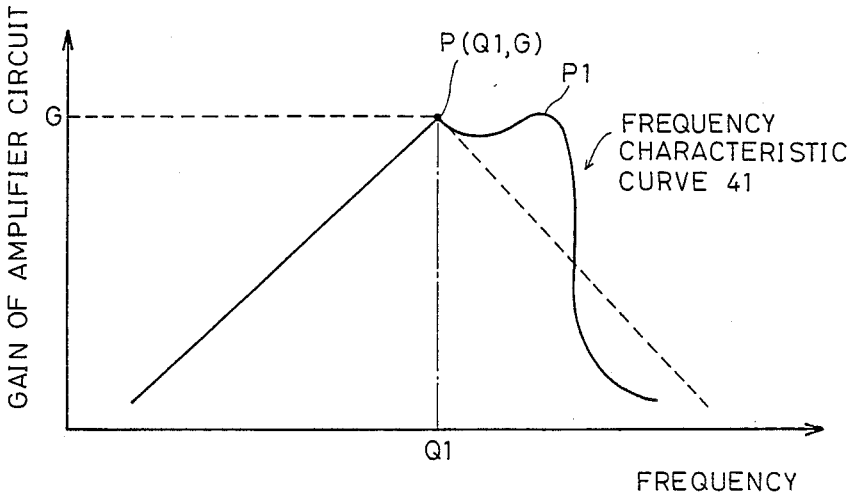
FIG. 2 is a schematic diagram illustrating the frequency characteristic of the sound effector of the present invention.
Figure 5:
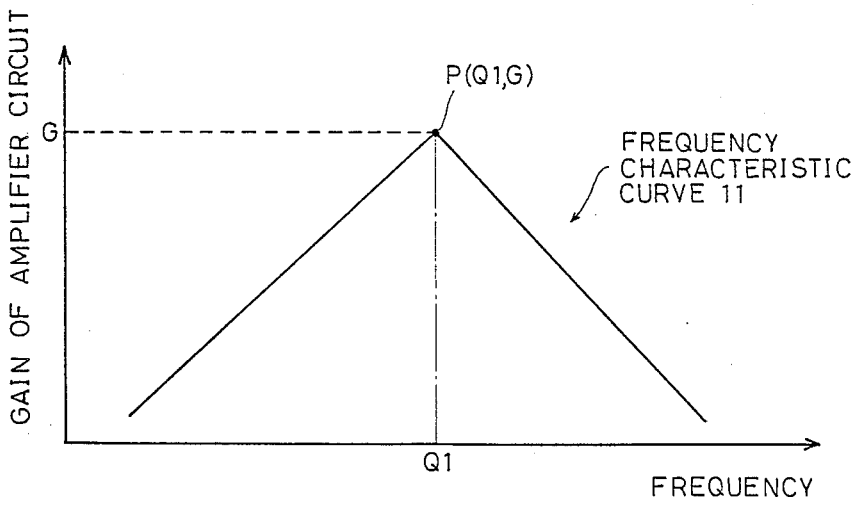
FIG. 5 PRIOR ART
FIG. 5 is a schematic diagram illustrating the frequency characteristic of the conventional sound effector.

As mentioned above, additional connection of the capacitor 34 induces, in the inductance 32 and the capacitor 34, a voltage higher than the output voltage generated by the inductance 32 itself of the pickup coil 31 having no resonance circuit. Accordingly, a higher voltage as compared with the case without the capacitor 34 is applied to the input 10A of the amplifier circuit 2. The resonance frequency of the resonance circuit may be selected to a higher value than 500 Hz, for example, at the peak P shown in FIG. 5, thereby correcting the characteristic in high frequency range shown in FIG. 5 by the amplifier circuit 2. As a result, a higher frequency than 500 Hz is boosted to provide a frequency curve 41 as shown in FIG. 2.

When the strings of an electric guitar are vibrated, the magnetic flux density of a core of the pickup coil 31 is changed, thereby changing the impedance $\omega L$ of the pickup coil 31. On the other hand, as a part of the signal from the filter 7 is positively fed back to the resonance circuit by the capacitor 35, oscillation is generated at audible high frequencies. Let Q2 denote the oscillation frequency. Then, the oscillation frequency Q2 varies with the impedance ωL in accordance with the following equation:

$$Q2 = \frac{1}{2}\pi \sqrt{\Delta\omega L \times C2} \quad (4)$$

where, ΔωL denotes the variation in impedance, and C2 denotes the capacitance of the capacitor 35. The variation ΔQ of the oscillation frequency Q2 is added to the original signal, and is modulated. Such a modulation is greatly effective to a player of the electric guitar or the like. Generally, inductance of the pickup coil 31 of the electric guitar is 200 mH (mili henry)—1 H (henry), and when the resonance frequency is set in the range of 2–8 kHz, the capacitance C1 of the capacitor 34 in the resonance circuit is not greater than 0.022 μF in consideration of a stray capacitance of a signal cable.

Thus, according to the present invention, the original sound signal modulation performed by the resonance operation, the amplifying operation and the positive feedback operation in the electronic circuit 30 having the resonance circuit, the amplifier circuit and the positive feedback circuit, may produce distinctive sounds having well-balanced volume and tone, such as strong sounds, delicate tone nuances, sound uniformity, good separation of sounds in each string during chord playing, and clear sounds. A frequency characteristic curve of such distinctive sounds is shown in FIG. 2 in contrast to the frequency characteristic curve 11 shown in FIG. 5. The frequency characteristic curve shown in FIG. 2 is a frequency characteristic of an output signal from the electronic circuit 10 in which the capacitor 34 is connected with the pickup coil 31. As may be seen, the peak P1 of the frequency characteristic curve 41 varies with the capacitance of the capacitor 34, that is, the resonance frequency.

The sound effectors where the electronic circuit 30 is applicable includes various types in addition to the foregoing distortion type. For instance, they are over drive type, metal type, graphic equalizer type, chorus and flanger type, phaser type, delay and reverb type, compressor and sustainer type, octaver type, auto wow and auto mute type, noise gate type, vibrato and tremolo type, parametric equalizer type and power booster type.

Having thus described the preferred embodiment of the invention, it should be understood that numerous structural modifications and adaptations may be made without departing from the spirit of the invention.

What is claimed is:

1. A sound effector for changing original sounds generated from an electric musical instrument and picked up by a pickup means having an inductance circuit into aurally improved distinctive sounds by suitably distorting the waveform in a frequency band of original sound signals to be enhanced during amplification of the original sound signals, said sound effector comprising:

a resonance circuit having a first capacitor connected with said inductance circuit of said pickup means;

an amplifier circuit composed of semiconductor elements for amplifying an output signal from said resonance circuit;

a filter circuit for receiving the output signal from said amplifier circuit and passing therethrough a signal having a predetermined frequency range;

a clipping circuit having two diodes connected between said amplifier circuit and said filter circuit; and a positive feedback circuit having a second capacitor connected between said filter circuit and said resonance circuit and serving to positively feed back a signal passed through said clipping circuit and said filter circuit connected to said resonance circuit;

wherein the resonance frequency in said resonance circuit is higher than the frequency at which the gain of an electric circuit including said amplifier circuit, said clipping circuit and said filter circuit is maximum.

2. The sound effector as defined in claim 1, wherein said amplifier circuit comprises an operational amplifier.

3. The sound effector as defined in claim 1, wherein the output signal from said first capacitor in said series resonance circuit is applied to said amplifier circuit.

* * * * *